US005125310A

United States Patent [19]

Lombino

[11] Patent Number: 5,125,310

[45] Date of Patent: Jun. 30, 1992

[54] PIANO FORTE HAMMER AND METHOD OF MAKING SAME

[75] Inventor: James M. Lombino, New Rochelle, N.Y.

[73] Assignee: Steinway Musical Properties, Inc., Waltham, Mass.

[21] Appl. No.: 657,882

[22] Filed: Feb. 19, 1991

Related U.S. Application Data

[63] Continuation of Ser. No. 378,047, Jul. 11, 1989, abandoned, which is a continuation-in-part of Ser. No. 353,924, May 18, 1989, abandoned.

[51] Int. Cl.[5] ..... G10C 3/18

[52] U.S. Cl. ..... 84/254

[58] Field of Search ..... 84/243, 254

[56] References Cited

U.S. PATENT DOCUMENTS

| | | | |
|---|---|---|---|
| 231,629 | 8/1880 | Steinway | 84/254 |
| 231,630 | 8/1880 | Steinway | 84/254 |
| 3,805,662 | 4/1974 | Nishimura et al. | 84/254 |

OTHER PUBLICATIONS

Product Literature and Material Safety Data Sheet—"Rhoplex E-32" Rohm and Haas Company (1987).

Product Literature and Material Safety Data Sheet—"TRITON X-14" Nonionti Surfactant", Rohm and Haas Company (July 1986).

Product Literature and Selected Material Safety and Product Data Sheets—"TINT-AYD WD", Daniel Products Company (1987).

*Primary Examiner*—Mark J. Reinhart
*Assistant Examiner*—Cassandra C. Spyrou
*Attorney, Agent, or Firm*—Fish & Richardson

[57] ABSTRACT

A piano forte hammer includes an elongated head having a nose defining side surfaces, and a felt body extending about the nose portion, with tail portions of the felt body affixed upon the side surfaces. The tail portions contain a predetermined measured amount of an acrylic copolymer. In preferred embodiments, the hammer is formed by a process including the steps of: providing a first volume of an aqueous solution containing the predetermined measured amount of acrylic copolymer in a slot, disposing a first tail portion of the felt body in the solution, allowing the felt body to draw essentially all of the solution from the slot by natural wicking action, providing a second volume of an aqueous solution containing the predetermined measured amount of acrylic copolymer in a slot, disposing a second tail portion of the felt body in the solution in the slot, and allowing the felt body to draw essentially all of the solution from the slot by natural wicking action.

5 Claims, 2 Drawing Sheets

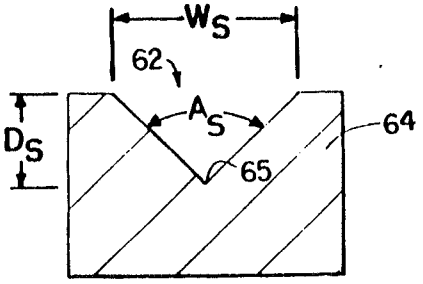
FIG. 3
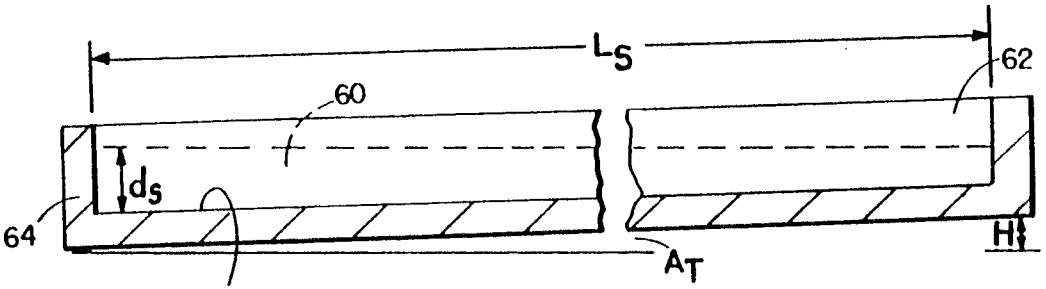
FIG. 3A
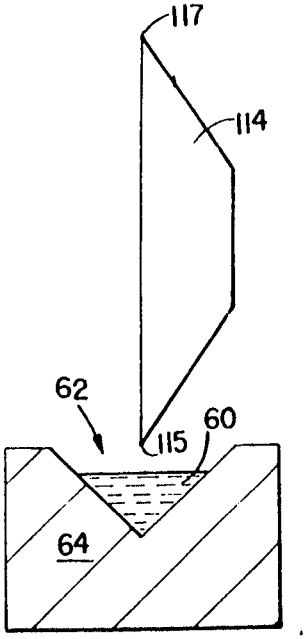
FIG. 4A
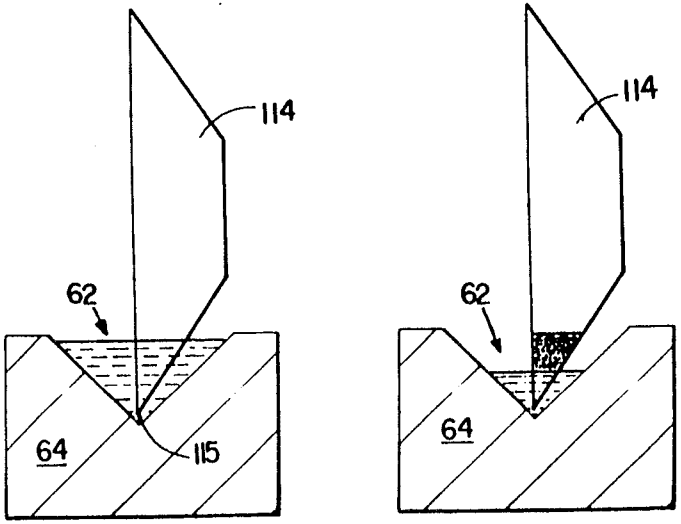
FIG. 4B
FIG. 4C
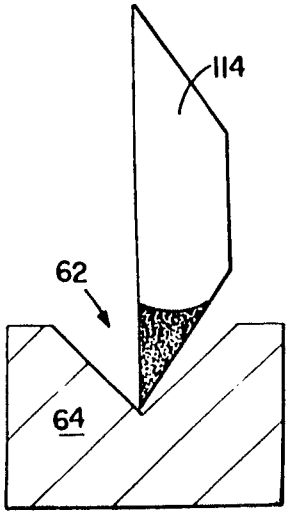
FIG. 4D

PIANO FORTE HAMMER AND METHOD OF MAKING SAME

This application is a continuation of application Ser. No. 07/378,047, filed Jul. 11, 1989, now abandoned, which was a continuation-in-part of U.S. Ser. No. 353,924, filed May 18, 1989, now abandoned. The invention relates to piano-forte hammers and, in particular, to an improved method for forming such hammers.

A piano hammer typically consists of a wooden head having a felt body compressed about its nose, the felt having tail regions which are attached to the head. The felt is locally treated to make the tail regions relatively stiff and inflexible in order to reduce the tendency for lateral expansion and thus increase the durability of the hammer. At a time when glues suceptible to moisture attack, e.g. animal glues, were employed, the felt treatment also served to resist wicking of moisture to the glue interface. The treatment also hardens the surface of the felt, thus providing a better surface for attachment to the head, and the comparatively non-extensile stiffened tail regions of the felt cause the central outer region of the felt to be subjected to extreme tension when bent around and secured to the wooden head. Steinway U.S. Pat. No. 231,630 (1880) describes a solution of liquid bichromate of potassium (a toxic, corrosive and costly chemical) and gelatine applied to the edge or tail portions of the felt with a brush in order to obtain the advantages described above. In about 1960, alcohol was added to the formulation in an effort to increase penetration into the felt body, and the felt body was treated by dipping into a tank of solution, with penetration estimated by observing the surface of the felt.

SUMMARY OF THE INVENTION

According to the invention, a piano forte hammer comprises an elongated head having a nose portion defining side surfaces, and a felt body disposed to extend about the nose portion and having first and second tail portions affixed upon the side surfaces, the tail portions containing a predetermined measured amount of an acrylic copolymer. The hammer is formed by a process comprising the steps of: providing a first volume of an aqueous solution containing the predetermined measured amount of acrylic copolymer in a slot, disposing a first tail portion of the felt body, prior to assembly about the nose portion, in the solution in the slot, allowing the felt body to draw essentially all of the solution from the slot by natural wicking action, providing a second volume of an aqueous solution containing the predetermined measured amount of acrylic copolymer in a slot, disposing a second tail portion of the felt body, prior to assembly about the nose portion, in the solution in the slot, and allowing the felt body to draw essentially all of the solution from the slot by natural wicking action.

According to another aspect of the invention, a piano forte hammer comprises an elongated head having a nose portion defining side surfaces, and a felt body disposed to extend about the nose portion and having first and second tail portions affixed upon the side surfaces, the tail portions containing a predetermined measured amount of an acrylic copolymer.

According to still another aspect of the invention, a method for forming a piano forte hammer is described.

In preferred embodiments of the invention, the solution comprises a surfactant; and the solution comprises pigmentation, preferably resembling potassium bichromate.

Thus there is provided a method for forming piano hammers including applying a novel treatment solution in a manner that results in penetration of a predetermined, selected amount of solution for treatment of a preselected region of the felt, and resulting in formation of piano hammers of improved uniform performance characteristics.

These and other features and advantages will be seen from the following description of a presently preferred embodiment, and from the claims.

PREFERRED EMBODIMENT

We first briefly describe the drawings.

FIGS. 3 and 3A are end and side section views, respectively, of a trough for treatment of an outer felt strip according to the method of the invention; FIGS. 4A et seq. are diagrammatic face views of the process for treatment of an outer felt strip of the hammer of the invention;

Figure 1:
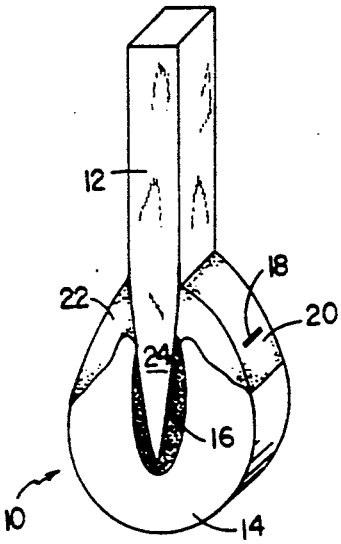
FIG. 1 is a perspective view of a piano forte hammer of the invention.

Referring to FIG. 1, a piano forte hammer 10 consists of a wooden head 12, an outer felt 14 and an under felt 16. The felt is 100% wool (so-called "hammer felt" ), e.g. as supplied by American Felt Co., Newburgh, N.Y. A wire staple 18, e.g., as described in Steinway U.S. Pat. No. 231,629 (1880), extends through the treated tail regions 20, 22 of the felt and through the wooden head, above the nose region 24.

Figure 2:
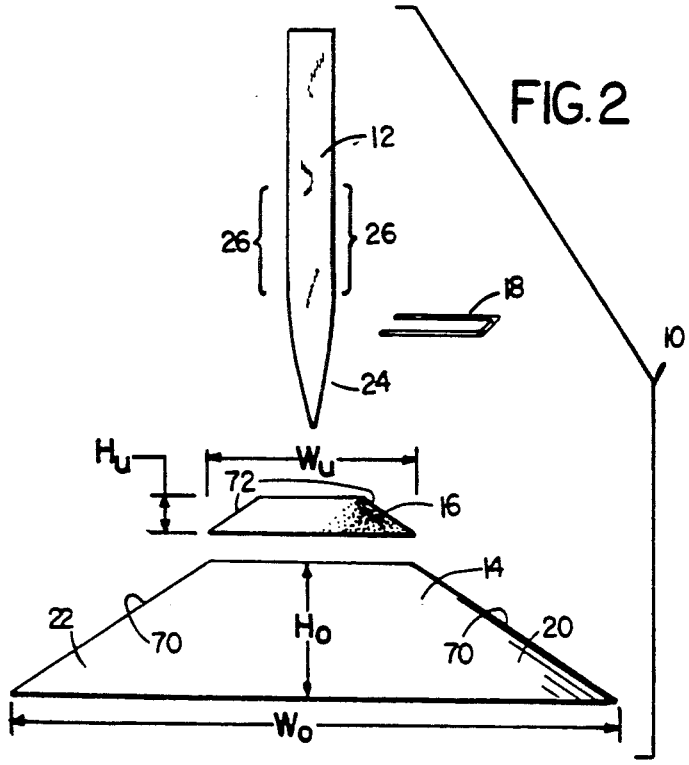
FIG. 2 is an exploded face view of the piano forte hammer of FIG. 1.

As shown in FIG. 2 in exploded view, the outer felt 14 and under felt 16, prior to assembly with the head, are trapezoidal in shape, the outer felt having base width, Wo, and height, Ho. The under felt has base width, Wu and height, Hu.

Hammer felt provided in sheets is cut into trapezoidal strips, each of length sufficent for formation of all 88 hammers for a single piano, e.g. about 44 inches. The strip tapers in base width and height from one end, from which the bass piano hammers are formed, to the other, from which the treble piano hammers are formed. For example, the width Wo of a typical strip decreases from $4\frac{1}{2}$ inches to $3\frac{1}{2}$ inches and height Ho from 1 inch to $\frac{1}{8}$ inch. The width Wu of a corresponding under felt decreases from $1\frac{1}{2}$ inch to 1 inch and height Hu from $\frac{1}{4}$ inch to 3/32 inch.

According to the improved method of the invention, the outer felt is treated with the solution of the invention, consisting of an aqueous solution of an acrylic emulsion and a surfactant.

By way of example only, a typical formulation is as follows:

| | |
|---|---|
| RHOPLEX E-32 (a self reactive acrylic copolymer emulsion, provided by Rohm and Haas Company of Philadelphia, PA) | 5.91 parts (by weight) |
| TRITON X-114 (a surfacant consisting of octylphenoxypolyethoxyethanol, also provided by Rohm and Haas Company) | 0.01 parts |
| TINT-AYD WD 2432 (a pigment consisting | 4.41 parts |

-continued

| | |
|---|---|
| of light lemon yellow oxide (60.0% by weight), surfacants (7%), propylene glycol (24.0%), water (9.0%), as provided by Daniel Products Company, Jersey City, New Jersey) | |
| TINT-AYD WD 2345 (a pigment consisting of carbon black (32.0% by weight), surfactants (2.0%), propylene glycol (40.5%) and water (25.5%), as provided by Daniel Products Company) | 0.09 parts |
| TINT-AYD 2630 (a pigment consisting of red oxide medium (60.0% by weight), surfactants (6.0%), propylene glycol (25.0%) and water (9.0%), as provided by Daniel Products Company) | 0.05 parts |
| Water | 89.53 parts |
| TOTAL | 100.0 parts (by weight) |

The pigmentation is selected to resemble the appearance of potassium bichromate, as used in prior art piano forte hammers.

Referring now to FIGS. 3 and 3A, there is provided a slot 62 in trough 64, of length and width to receive a predetermined volume of solution for treatment of one tail edge region of an entire strip 114. For example, the slot has width Ws at the top, about 2 inches, and the walls slant inwardly to intersect at angle As, about 90°, at the bottom with a depth ds, about 1 inch. Referring also to FIG. 4, the slot has length $L_s$, about 45 inches. The trough is disposed with the bottom 65 of the slot at an angle $A_T$ to horizontal, so the depth, $d_s$, of the solution in the slot at the bass end is less than at the treble end. For example, the base at the treble end is disposed at height H above the bass end, e.g. ¾ inch, and depth $d_s$ at the bass end is typically about ⅝ to ¾ inch.

The slot is filled with a predetermined measured volume of solution 60, e.g., typically about 100 milliliters. The outer felt 114 is oriented as shown in FIGS. 4A–4D, and the tail edge 115 is dipped into the solution 60 (FIG. 4B). The felt draws the solution up by natural wicking action (FIG. 4C) and is left in the slot until all of the solution is absorbed (FIG. 4D). The solution is absorbed along the entire strip with the ratio of treated portion to untreated portion at the bass end generally equal to the ratio of treated portion to untreated portion at the treble end and all along the length of strip therebetween. In this manner, each strip is caused to absorb no more or no less solution than other strips treated according to the invention, resulting in piano forte hammers of uniform performance and appearance.

The strip 114 is removed from the slot and the slot is refilled with solution. The strip 114 is reversed and the opposite tail edge 117 is disposed in the slot to absorb the measured, predetermined volume of solution.

Figure 5:
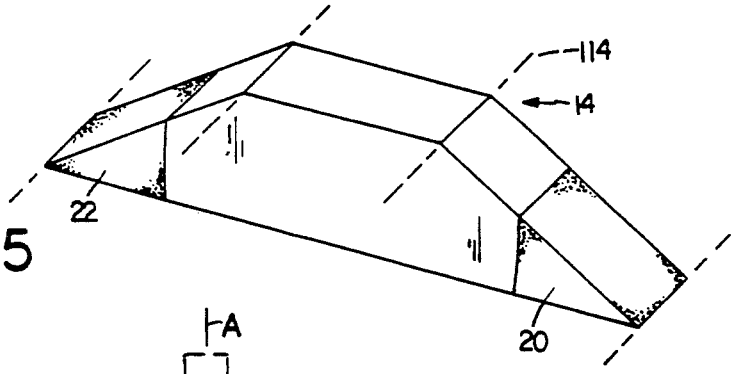
FIG. 5 is a perspective view of the outer felt strip of FIG. 4A et seq. after treatment according to the invention.

The treated strip 114, having treated tail regions 20, 22 (FIG. 5) is dried overnight in an oven at 150° F.

Figure 6:
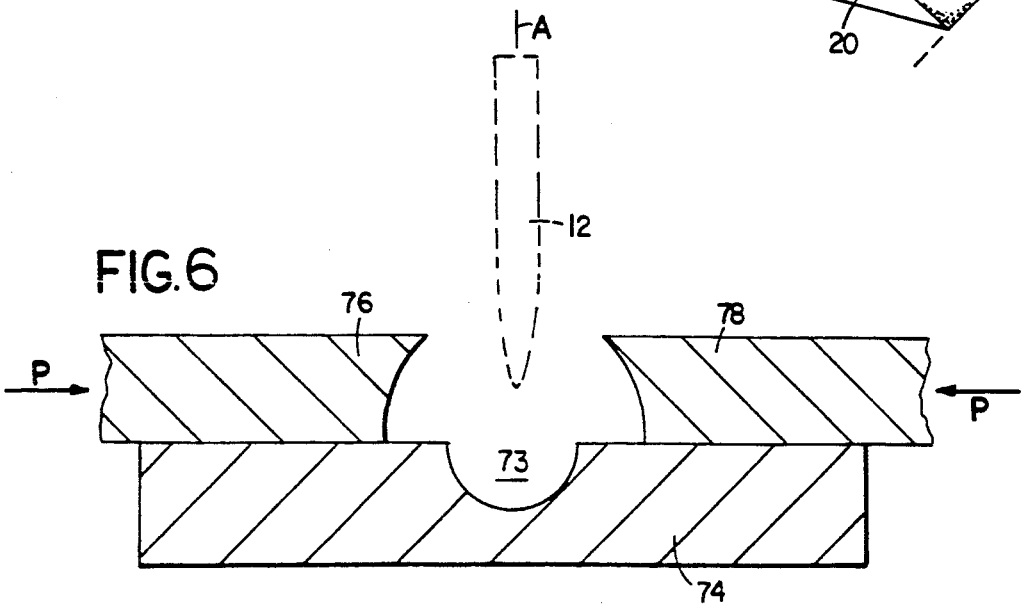
FIG. 6 is a somewhat diagrammatic end view of the mold for forming piano of the invention.

Referring to FIG. 6, the components (FIG. 2) are then assembled by molding in the usual manner, e.g., as follows. Adhesive, e.g., urea formaldehyde, is applied to felt surfaces 70, 72. A complete set of wooden heads are disposed above strips 14, 16 over a cavity 73 of mold 74, the cavity having the shape of the lower portion of the hammer. Axial force (arrow A) is applied to the wooden heads 12 to press the felts into the mold cavity. Mold side jaws 76, 78 are then actuated (arrows P) to force the treated portions of felt into contact with the side surfaces 26 of the nose region 24 of wooden head 12. The felts 14, 16 are secured in place by the adhesive. The hammers 10 are separated by cutting the strips vertically between heads. Wire staples 18 are pressed through the outer felt in the treated region and wooden head (above the ends of the under felt) and the staple ends twisted for reinforcement of the attachment of the felt to the head, to further secure the hammer against loss of shape over time.

Other embodiments are within the following claims. For example, the pigments in the described formulation may be omitted, or other pigment combinations employed.

What is claimed:

1. A method for forming a piano forte hammer, comprising the steps of:

providing an elongated head having a nose portion defining side surfaces, and providing a felt body comprising a nose region adapted for contact upon a piano string and first and second tail regions, providing a first volume of an aqueous solution containing a predetermined measured amount of acrylic copolymer in a slot, disposing the first tail region of said felt body in said solution in said slot, allowing said felt body to draw essentially all of said solution from said slot, into said first tail region only, by natural wicking action, providing a second volume of an aqueous solution containing said predetermined measured amount of acrylic copolymer in the slot, disposing the second tail region of said felt body in said solution in said slot, allowing said felt body to draw essentially all of said solution from said slot, into said second tail region only, by natural wicking action, said nose region of said felt body being essentially free of said acrylic copolymer, disposing said felt body about said nose portion under pressure, and affixing surfaces of said tail regions in contact upon said side surfaces of said elongated head.

2. The method of claim 1 wherein said solution comprises a surfactant.

3. The method of claim 1 wherein said solution comprises pigmentation.

4. The method of claim 3 comprising the further step of formulating said pigmentation to cause said tail regions to resemble in coloration tail regions of piano forte hammers treated with potassium bichromate.

5. The method of claim 1 wherein said elongated head comprises a segment of a head strip and said felt body disposed in said solution in said slot comprises a segment of a strip of felt and said method comprises the further steps of separating said strip of felt affixed to said head strip, and said head strip, into a plurality of piano forte hammers.

* * * * *